United States Patent [19]

Kato

[11] Patent Number: 4,601,420

[45] Date of Patent: Jul. 22, 1986

[54] ROLL FEED APPARATUS

[75] Inventor: Heizaburo Kato, Shizuoka, Japan

[73] Assignee: Sankyo Manufacturing Company, Ltd., Tokyo, Japan

[21] Appl. No.: 716,009

[22] Filed: Mar. 26, 1985

[51] Int. Cl.[4] ..... B65H 20/04

[52] U.S. Cl. ..... 226/154; 226/142; 226/149; 226/158; 226/161

[58] Field of Search ..... 226/158, 161, 162, 163, 226/154, 152, 139, 140, 141, 142, 147, 149; 74/25, 27, 40, 44, 45, 49, 50, 53

[56] References Cited

U.S. PATENT DOCUMENTS

| | | | |
|---|---|---|---|
| 2,946,586 | 7/1960 | Pityo | 226/154 |
| 2,946,588 | 7/1960 | Pityo | 226/154 X |
| 3,493,159 | 2/1970 | Balunas, Jr. et al. | 226/154 X |
| 3,758,011 | 9/1973 | Portmann | 226/142 |
| 4,316,569 | 2/1982 | Gentile | 226/158 |
| 4,333,593 | 6/1982 | Bihler et al. | 226/158 X |
| 4,475,678 | 10/1984 | Katoh | 226/143 |
| 4,487,352 | 12/1984 | Paris | 226/142 |

FOREIGN PATENT DOCUMENTS

| | | | |
|---|---|---|---|
| 565212 | 11/1944 | United Kingdom | 226/154 |
| 633704 | 12/1949 | United Kingdom | 226/154 |
| 726356 | 3/1955 | United Kingdom | 226/154 |

*Primary Examiner*—Stanley N. Gilreath

*Attorney, Agent, or Firm*—Pollock, Vande Sande & Priddy

[57] ABSTRACT

A roll feed apparatus for intermittently feeding a sheet-like blank material to successive work stations has a pair of sector rolls adapted to be driven by an oscillation driving device in synchronism with each other such as to clamp the material therebetween and feed the same intermittently in one direction, by virtue of a driving connection device which drivingly connects the rolls to the oscillation driving device. The apparatus further has a roll release device adapted to move the rolls away from each other when the rolls are oscillated in the directions counter to the feeding directions thereby releasing the sheet-like blank material from the clamping force.

5 Claims, 5 Drawing Figures

ROLL FEED APPARATUS

BACKGROUND OF THE INVENTION

Field of the Invention

The present invention relates to a roll feed apparatus for feeding intermittently a sheet-like blank material to a processing station on a step-by-step basis. More particularly, the invention concerns a roll feed apparatus which includes a first roll and a second roll for feeding intermittently a strip-like sheet material to one or more work stations such as metallic molds in a selective manner and which is suited to be incorporated in an automated manufacturing machines or other machine tools.

A known roll feed apparatus of the kind mentioned above comprises a oscillation driving means, a first roll integrally carried by a first roll shaft, a second roll integrally carried by a second roll extending in parallel with the first roll shaft and adapted to cooperate with the first roll in clamping a sheet-like blank material therebetween such as to feed the sheet-like blank material, a connecting device for operatively connecting the oscillation driving device to the first and second rolls such that, when the first roll rocks in one direction by a predetermined amount, the second roll rocks in the opposite direction by an amount substantially equal to the oscillation of the first roll, and a roll release device adapted for moving the first and second rolls away from each other thus releasing the clamping force of the first and second rolls on the sheet-like blank material.

This type of roll feed apparatus is shown, for example, in the specification of the U.S. Pat. No. 4,475,678. This roll feed apparatus provides a considerably high precision of feed of the sheet-like blank material during the high-speed operation. However, since the driving connecting device for operatively connecting both rolls includes a pair of gears, it is quite difficult to completely eliminate any impairment of feeding precision attributable to the presence of back-lash in the meshing gears. In addition, an expensive and heavy coupling has to be used in order to allow both rolls to be moved towards and away from each other for clamping and releasing the sheet-like blank material, while maintaining the driving connection between both rolls through the pair of gears.

Our co-pending U.S. patent application Ser. No. 519,174 filed on Aug. 1, 1983 discloses a roll feed apparatus which eliminates the drawbacks of the prior art shown in the above-mentioned United States Patent and ensures a higher precision of feed.

More specifically, in this roll feed apparatus, the driving connecting device includes a first oscillation arm mounted on the first roll shaft and driven by the oscillation driving device such as to oscillate together with the first roll shaft and the first roll, a second oscillation arm mounted on the second roll shaft and disposed substantially on the same plane as the first oscillation arm, a guide member disposed near the point of intersection between the above-mentioned plane and the path of feed of the sheet-like blank material and provided with a guide groove extending in the direction of feed of the sheet-like blank material, a slider slidable in the guide groove, and a first link and a second link connecting the slider to the first and second oscillation arms, the first and second link being arranged substantially in symmetry with each other with respect to the plane of path of feed of the sheet material, at such an inclination to the plane as to form a shape like V having an apex located at the position of the slider.

This known roll feed apparatus, however, still suffers from problems or deficiencies in that it requires too many movable parts or link members constituting the driving connection device and in that the synchronism of operation of two rolls may be lost due to the fact that the second roll is not directly driven by the oscillation driving device but is driven by the power derived from the first roll and transmitted thorugh the driving connection means. These deficiencies constitute a bottleneck in the attainment of a further improvement in the feeding precision.

SUMMARY OF THE INVENTION

Accordingly, an object of the invention is to provide a roll feed apparatus capable of intermittently feeding a sheet-like blank material with a high precision even during high speed operation, thereby overcoming the problems and deficiencies encountered by the prior arts shown in the United States Patent and United States Patent Application mentioned before.

To this end, according to the invention, there is provided a roll feed apparatus comprising: an oscillation driving device; a first roll integrally mounted on a first roll shaft; a second roll integrally mounted on a second roll shaft extending in parallel with the first roll shaft and adapted for cooperation with the first roll in clamping therebetween a sheet-like blank material and feeding the same; a driving connection means drivingly connecting the oscillation driving means to the first and second rolls in such a manner that, when the first roll is oscillated in one direction by a predetermined amount, the second roll is oscillated in the opposite direction by the same amount; and a roll release device adapted to move the rolls away from each other when the rolls are oscillated in the counter directions thereby releasing the sheet-like blank material from the clamping force; wherein the driving connection device includes a first block fixed to the housing of the roll feed apparatus and having a first guide groove extending in the direction of feed of the sheet-like blank material in alignment with the path of feed, a slider slidably engaging the first guide groove, a connecting rod through which the oscillation driving device is connected to the slider, a second block integral with the slider and having a second guide groove which orthogonally crosses the first guide groove and extending in the direction of movement of the rolls caused by the operation of the roll release device, a first arm integrally fitted at its one end to the first roll shaft and provided at its other end with a rolling member which engages with the second guide groove, and a second arm integrally fitted at its one end to the second roll shaft and provided at its other end with a rolling member engaging with the second guide groove and arranged in symmetry with the first arm with respect to the path of feed of the sheet-like blank material.

The above and other objects, features and advantages of the invention will become clear from the following description of the preferred embodiment when the same is read in conjunction with the accompanying drawings.

DESCRIPTION OF THE PREFERRED EMBODIMENT

A preferred embodiment of the invention will be described hereinunder with reference to the accompanying drawings.

Figure 1:
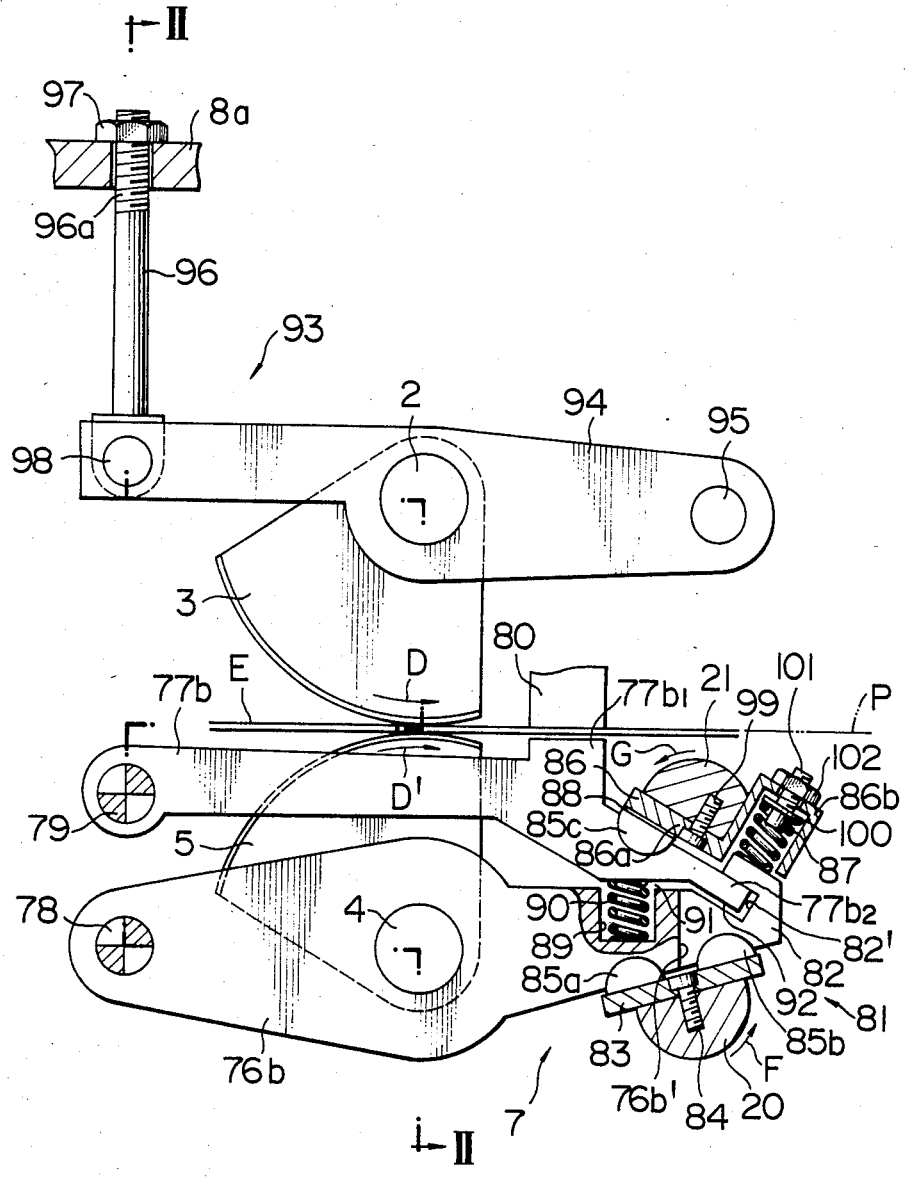
FIG. 1 is a side elevational view of a roll feed apparatus in accordance with the invention.
Figure 2:
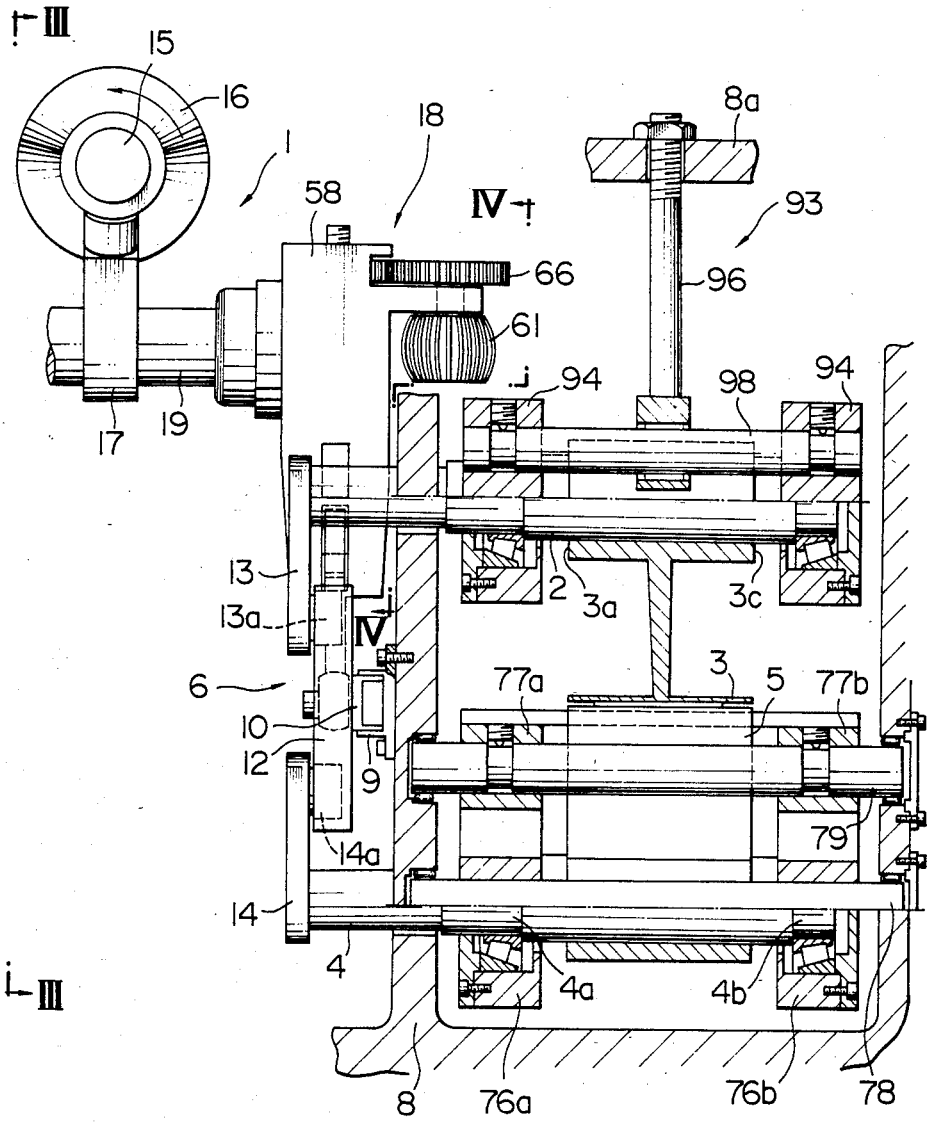
FIG. 2 is a view taken along arrow lines II—II showing the general arrangement of the roll feed apparatus.

Referring first to FIG. 2, a roll feed apparatus embodying the present invention has an oscillation driving device 1, a first roll 3 integrally mounted on a first roll shaft 2, a second roll 5 integrally mounted on a second roll shaft 4 extending in parallel with the first roll shaft 4 and adapted for cooperating with the first roll 3 in clamping therebetween a sheet-like blank material and feeding the same, a driving connection device 6 for drivingly connecting the oscillation driving device 1 to the first and second rolls 3, 5, and a roll release device 7 which will be detailed later in connection with FIGS. 1 and 2.

Figure 3:
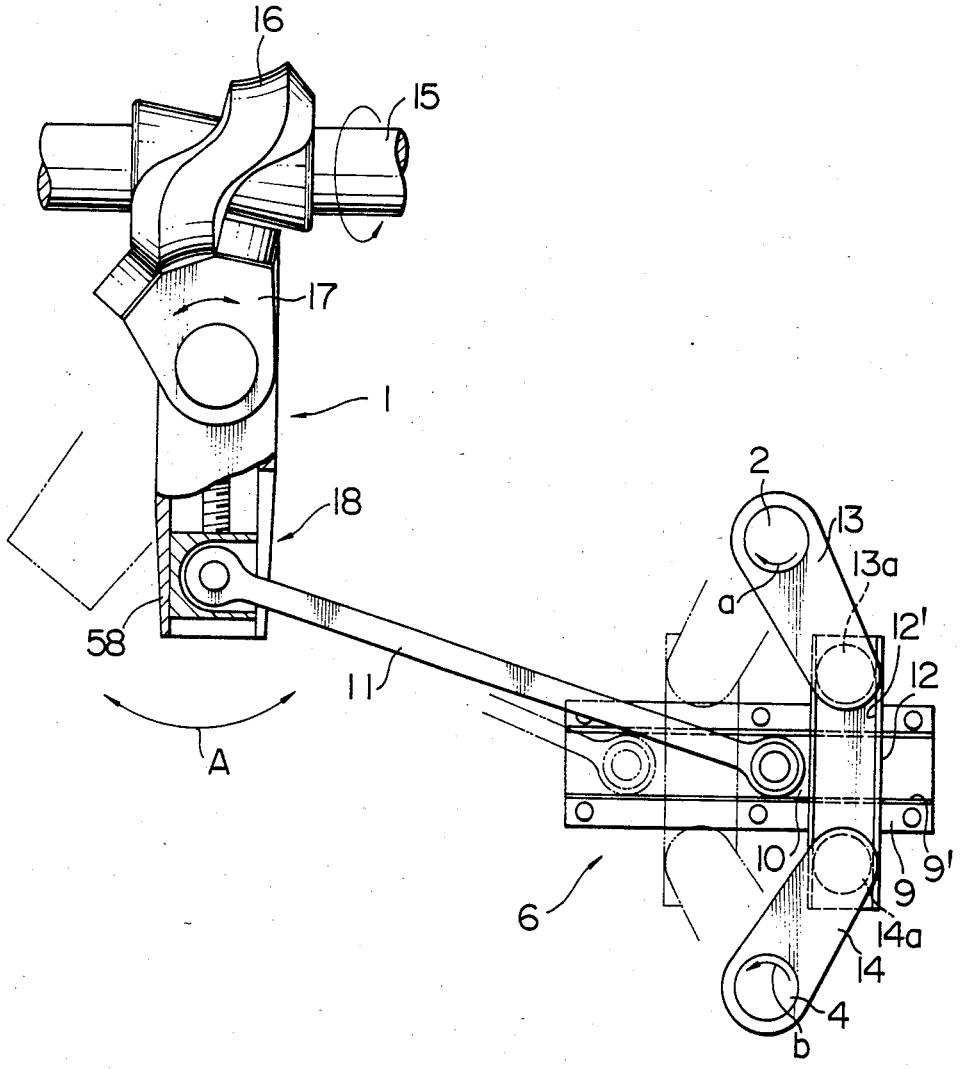
FIG. 3 is a view taken in the direction f arrow lines III—III of FIG. 2, showing the construction of a driving connection device in connection with an oscillation driving means.

As will be seen from FIGS. 2 and 3, the driving connection device 6 in the described embodiment has a first block 9 fixed to a housing 8 and provided with a first guide groove 9' extending in the direction of feed of the sheet-like blank material, i.e., to the left and right as viewed in FIGS. 1 and 2, a slider 10 slidable in the first guide groove 9', a connecting rod 11 operatively connecting the oscillation driving device 1 to the slider 10, a second block 12 integral with the slider 10 and provided with a second guide groove 12' orthogonally crossing the first guide groove 9' and extending in the direction of movement of both rolls caused by the roll release device 7 which will be mentioned later, i.e., upward and downward as viewed in FIG. 3, a first arm 13 integrally mounted at its one end to the first roll shaft 2 and provided at its other end with a rolling member **13*a* engaging a portion of the second guide groove 12' near the top end thereof as viewed in FIG. 3, and a second arm 14 integrally fixed at its one end to the second roll shaft 4 and provided at its other end with a rolling member 14*a* engageable with a portion of the second guide groove 12' as viewed in FIG. 3, the second arm 14 being arranged in symmetry with the first arm 13** with respect to the path of movement of the sheet-like blank material, i.e., with respect to the neutral axis of the first guide groove.

The driving connection device 6 is constructed such that, when an oscillation member 58 oscillates as indicated by arrows A by the operation of the oscillation driving device 1, the first roll 3 and the second roll 5 are made to oscillate in opposite directions substantially by the same amount. More specifically, assuming here that the oscillation member 58 oscillates clockwise as viewed in FIG. 3 over a predetermined angle, this oscillation is transmitted through the connecting rod 11 to the slider 10 such as to cause a sliding motion of the slider 10 along the first guide groove 9' to the left and the second block 12 integral with the slider 10 is also moved to the left. This movement of the second block 12 in turn causes the first arm 13 and the second arm 14 to oscillate clockwise and counter-clockwise, respectively, with the rolling members **13*a* and 14*a* rolling along the second guide groove 12'. In consequence, the first roll shaft 2 and the second roll shaft 4 which are integral with the first arm 13 and the second arm 14 are rotated clockwise and counter-clockwise, respectively, as indicated by arrows a and b, followed by oscillation or rotation of the first roll 3 and the second roll 5. The states of the oscillation member 58 and constituents of the driving connection device 6 after the clockwise oscillation of the oscillation member 58 are shown by chain lines in FIG. 3**.

Similarly, when the oscillation member 58 oscillates counter-clockwise from the position shown by the chain line in FIG. 3, this motion is transmitted through the connecting rod 11 to the slider 10 thus causing the slider 10 to slide to the right, so that the first and second roll shafts 2 and 4 rotate counter-clockwise and clockwise, respectively, through the action of the second block 12 and the first and second arms 13 and 14. Consequently, the first roll 3 and the second roll 5 oscillate counter-clockwise and clockwise, respectively, together with the first roll shaft 2 and the second roll shaft 4.

The oscillation driving device 1 is of the type known per se. Namely, the oscillation driving device 1 has three-dimentional cams, only one of which is shown and denoted by a numeral 16 in FIGS. 2 and 3. These three-dimentional cams 16 are fixed to an input shaft 15 which is driven continuously. The oscillation driving device 1 further has three turrets engaging with respective three-dimensional cams and adapted to make oscillation in accordance with the forms of the three-dimensional cams. In FIGS. 2 and 3, only one of three turrets is shown and designated at a numeral 17. One of the turrets 17 is connected to an oscillation angle changing device 18 through a connecting shaft 19, while two other turrets, which are not shown, are connected to a first oscillation shaft 20 and a second oscillation shaft 21 which will be explained later with reference to FIG. 1, such as to oscillate the oscillation shafts in a timed relation as will be explained later.

Figure 4:
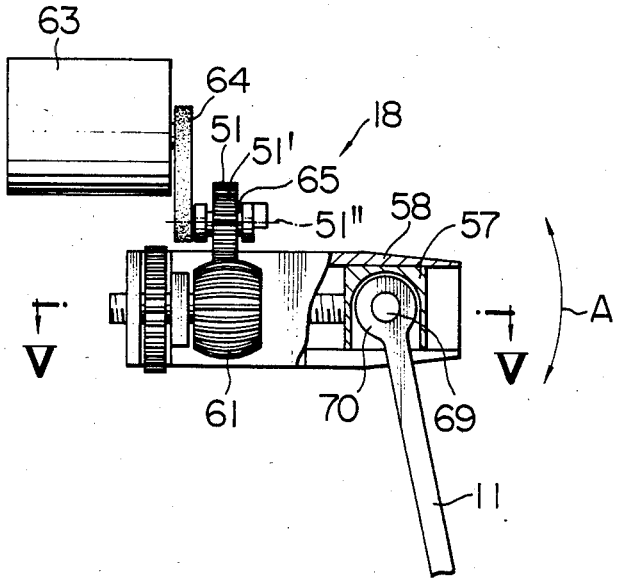
FIG. 4 is a view taken along arrow lines IV—IV in FIG. 2, showing particularly the construction of an oscillation angle changing means.
Figure 5:
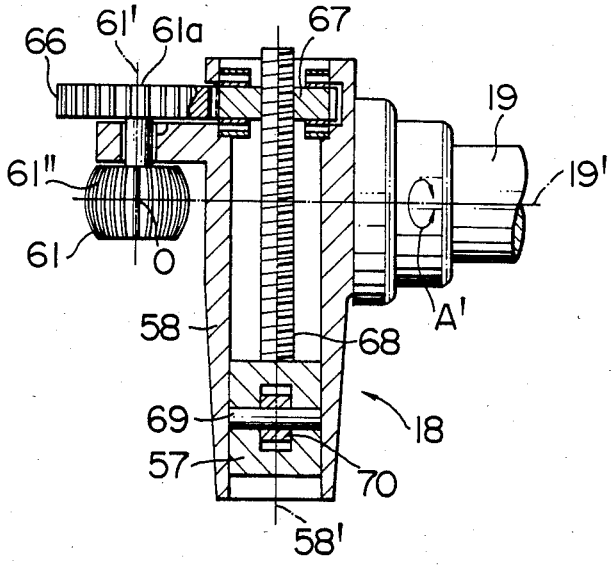
FIG. 5 is a sectional view taken along the line V—V of FIG. 4.

As clearly shown in FIGS. 4 and 5, the oscillation angle changing device 18 has the oscillation member 58 which extends substantially perpendicularly to the connecting shaft 19 as shown in FIG. 5 and integrally connected at its one end to the connecting shaft 19, a slider 57 mounted in the oscillation member 58 and connected to one end of the connecting rod 11, a crown gear 61 mounted on the oscillation member 58, and a spur gear rotatably mounted on the housing of the oscillation driving device 11 and engaging with the crown gear 61. When the connecting shaft 19 oscillates as shown by arrows A' as a unit with the turret 17, the crown gear 61 oscillates as indicated by arrows A as a unit with the oscillation member 58. The crown gear 61 is rotatable about an axis 61' which orthogonally crosses the axis 19' of the connecting rod 19, when viewed in a plane containing the axis 19' of the connecting shaft 19 and the axis 58' of the oscillation member 58. The crown gear 61 has a spherical surface centered at a point O of intersection between the axis 19' of the connecting shaft 19 and the axis 61' of rotation of the crown gear 61 and a multiplicity of teeth 61'' formed on the spherical surface. Each of the teeth 61'' extends in an arcuate form in the direction of the axis 61'. These teeth 61'' mesh with teeth 51' of the spur gear 51 extending linearly in the same direction. Therefore, when the crown gear 61 oscillates about the axis 19' of the connecting shaft 19 as indicated by arrows A', the arcuate teeth 61'' are allowed to move in the direction of an ark with respect to the teeth 51' of the spur gear. Conversely, when the spur gear 51 is rotated about its axis 51'', the crown gear 61 is made to rotate about the axis 61' thereof.

In FIG. 4, a reference numeral 63 designates a driving motor which is connected through a timing belt 64 to the shaft 65 carrying the spur gear 51 such as to drive the spur gear 51.

The crown gear 61 is carried by a rotary shaft 61*a* which is provided at its upper end as viewed in FIG. 5 with a driving gear 66 which in turn engages with an idle gear 67 screwed to the upper end of a screw rod 68 provided in the oscillation member 58. The screw rod 68 is connected at its lower end to a slider 57. Therefore, when the spur gear 51 is rotated by the motor 63, the crown gear 61 is rotated together with the rotary shaft 61*a* about the axis 61' so that the idle gear 67 is rotated through the drive gear 66, thus causing the screw rod 68 and the slider 57 to slide in the direction of the axis of the oscillation member 58. The sliding movement of the slider 57 causes a change in the amount of movement of the slider 10 (see FIG. 3), i.e., the amount of sliding of the slider 10 along the first guide groove 9', for a given oscillation angle of the oscillation member 58, thereby changing the angle of oscillation of the rolls 3 and 5 for a given angle of oscillation of the oscillation member 58. It will be seen that, by changing the angle of oscillation of both rolls 3 and 5 with respect to a given oscillation angle of the oscillation member 58 and the connecting shaft 19 integral therewith, the amount or stroke of feed in the intermittent feeding of the sheet-like blank material is changed.

In FIGS. 4 and 5, reference numeral 69 and 70 denote a fixing pin provided on the slider 57 and a bearing member rotatably fitting the pin. The slider 57 is connected to the connecting rod 11 through the pin and the bearing member. A similar connecting construction is used for the connection between the connecting rod 11 and the slider 10.

As will be understood from the foregoing description, the first roll 3 and the second roll 5 are drivingly connected through the driving connection device 6 such that, when the first roll oscillates in one direction by a predetermined amount, the second roll oscillates in the opposite direction substantially by the same amount.

Referring back to FIG. 1, when the first roll 3 oscillates clockwise as indicated by an arrow D, the second roll 5 oscillates clockwise as indicated by an arrow D'. These oscillating directions of the rolls will be referred to as "feeding direction", hereinunder. If a sheet-like blank material is clamped between both rolls 1 and 3 when they oscillate in the feeding direction, the material is fed to the right by a distance or amount corresponding to the angle of oscillation of the first and second rolls 3 and 5. Conversely, when the first and second rolls oscillate clockwise and counter-clockwise, respectively, i.e., in the directions counter to the feeding directions, it is necessary that the first roll 3 and the second roll 5 are moved away from each other such as to unclamp the sheet-like blank material from these rolls, for otherwise the sheet-like blank material is fed back to the left undesirably. The movement of both rolls away from each other during oscillation thereof in the counter directions is effected by a roll release device 7 which will be explained with reference to FIGS. 1 and 2.

The roll release device 7 of the illustrated embodiment is designed to perform both releasing and braking functions: namely, the releasing function for moving both rolls 3 and 5 away from each other thus releasing the clamping and the braking function for temporarily fixing the sheet-like blank material such as to prevent the material to be further fed by inertia when it is released from the clamping force.

More specifically, the roll release device has a pair of release arms 76*a* and 76*b* which extend in the direction of path P of feed of the sheet-like blank material. The release arms 76*a* and 76*b* are carried substantially at their mid portions by portions 4*a* and 4*b* (see FIG. 2) of the second roll shaft 4 extending beyond the axial ends of the second roll 5. The roll release device further has a pair of brake arms 77*a* and 77*b* which are disposed between the release arms 76*a*, 76*a* and the path P of feed of the sheet-like blank material and extending in the direction of the path P. As will be seen from FIG. 1, one 76*b* of the release arm fits at its left end as viewed in FIG. 1 on a release pivot shaft 4 which extends substantially parallel with the second roll shaft 4 and mounted at its both ends by the housing 8 of the roll feed device as shown in FIG. 2. Similarly, the other release arm 76*a* fits at its one end on the same release pivot shaft 78. As will be seen from FIGS. 1 and 2, the ends of the brake arms 77*a* and 77*b* adjacent the release pivot shaft 78, i.e., the left ends as viewed in FIG. 1, fit on a common brake pivot shaft 79 which is disposed substantially in parallel with the second roll shaft 4 and mounted at its both ends by the housing 8 as shown in FIG. 2. A movable braking member 77*b*1 is formed on the portion of the brake arm 77*b* slightly offset in the feeding direction from the position of the rolls, such as to project towards the path P. A similar braking member (not shown) is formed on the brake arm 77*a*. These braking members are adapted to cooperate with a stationary braking member 80 which opposes the movable braking members across the path P, in fixing and releasing the sheet-like blank material E.

As shown in FIG. 1, the end of the release arm 76*b* remote from the release pivot shaft 78, i.e., the right end as viewed in FIG. 1, and the end of the brake arm 77*b* remote from the brake pivot shaft 79, i.e., the right end as viewed in FIG. 1, are operatively connected to an arm actuating device 81. The arm actuating device 81 has an arm connecting member 82 which slidably engages with the right end surface 76*b'* of the release arm 76*b* and provided with a groove 82' which loosely receives a projection 77*b*2 which projects obliquely downwardly from the right end of the brake arm 77*b*. The arm actuating device 81 also has a first oscillation shaft 20 and a second oscillation shaft 21 which are adapted to be oscillated by the oscillation driving device 1 (see FIGS. 1 and 2). A flat operation plate 83 is fixed to an upper portion of the first oscillation shaft 20 by means of a bolt 84. The upper surface of the operation plate 83 engages flat lower surfaces of semi-cylindrical joint members 85*a* and 85*b* which are received, respectively, by a semi-cylindrical recess formed in the lower surface of the release arm 76*b* and a semi-cylindrical recess formed in the lower surface of the arm connecting member. To the lower surface of the second oscillation shaft 21 is fixed by a bolt 99 an operation member 86 which has a flat plate portion 86*a* and a spring housing 86*b* integrally connected to the right end of the flat plate portion 86*a* and accommodating a second spring 87. The lower surface of the flat plate portion 86*a* oppose, leaving a third gap 88 therebetween, a flat upper surface of a semi-cylindrical joint member 85*c* which rotatably fits in a semi-cylindrical groove formed in the upper surface of the right end portion of the brake arm 77*b*.

The release arm 76*b* is provided at the right end portion thereof with an upwardly opened recess 89 receiving a first spring 90 the upper end of which acts on the lower surface of the brake arm 77*b* such as to urge the brake arm 77*b* and the release arm 76*b* away from each other. The second spring 87 in the spring housing 86*b* on the operation member 86 urges the arm connecting member 82 towards the projection 77*b*2 of the brake arm 77*b*. Therefore, a first gap 91 is formed between the upper surface of the release arm 76*b* and the lower surface of the brake arm 77*b* in the region near the first spring 90. A second gap 92, which communicates with the first gap 91, is formed between the lower surface of the upper projection 77*b*2 of the brake arm 77*b* and the opposing surface of the groove 82'. In FIG. 1, a reference numeral 100 designates a retainer plate mounted on a screw rod 101 and adapted for retaining the second spring 87, while a numeral 102 designates an adjusting nut screwed to the screw rod 101 and adapted for adjusting the force of the second spring 87.

The operation of the roll release device having the described construction operates in a manner which will be explained hereinunder with reference to FIG. 1.

In FIG. 1, both rolls 3 and 5 clamp a sheet-like blank material E therebetween. The first roll 3 and the second roll 5 are bound to oscillate in clockwise (arrow D) and counter-clockwise (arrow D'), i.e., in the feeding directions, by a predetermined amount such as to feed the sheet-like blank material E towards a working position assumed on the right side in FIG. 1 by a predetermined distance. After the rightward feed of the sheet-like blank material by a predetermined amount, both rolls 3 and 5 are stopped and the first oscillation shaft oscillates counter-clockwise as indicated by arrow F. As a result of this oscillation, the right portion of the release arm 76*b* is moved downwardly by the resilient force of the first spring 90, so that the release arm 76*b* is moved pivotally clockwise about the fulcrum constituted by the release pivot shaft 78. In consequence, the second roll shaft 4 and the second roll 5 are moved downwardly as a unit with each other, so that the second roll 5 leaves the sheet-like blank material E, thus releasing the clamping force which has been exerted on the sheet-like blank material E by both rolls. On the other hand, the oscillation of the first oscillation shaft 20 causes the arm connecting member 82 to be moved upwardly over coming the force of the second spring 87 through the joint member 85*b*. During this upward movement, the arm connecting member 82 slides on the right end surface 76*b*' of the release arm 76. In response to the upward movement of the arm connecting member, the right end portion of the brake arm 77*b* is urged upwardly by the force of the first spring 90. Therefore, the brake arm 77*b* is pivotally moved counter-clockwise about the fulcrum constituted by the brake pivot shaft 79, so that the movable braking member 77*b*1 is moved towards the stationary braking member 80 thereby brake and fix the sheet-like blank material E therebetween. It is to be understood that the counter-clockwise pivotal movement of the brake arm 77*b* in response to the oscillation of the first oscillation shaft 20 is never hindered by the second oscillation shaft 21 and the operation member 86 because of the presence of the third gap 88 between the lower surface of the flat plate portion 86*b* of the operation member 86 and the upper surface of the joint member 85*c*. Namely, the brake arm 7*b* is allowed to pivot counter-clockwise until the breadth of this third gap 88 becomes zero.

As has been described, according to the invention, the first oscillation shaft 20 oscillates counter-clockwise by a predetermined amount after the completion of the rightward feed of the sheet-like blank material E, so that the second roll 5 is moved away from the first roll 3 thereby releasing the clamping force on the sheet-like blank material, while fixing the sheet-like blank materkal by the movable braking member 77*b*1 and the stationary braking member 80. Since the sheet-like blank material is fixed by the braking member 77*b*1 and 80, the undesirable excessive feeding due to inertia is avoided when the material E is released from the clamping force and, therefore, the precision of the feed of the sheet-like blank material E is enhanced advantageously.

As stated before, the first oscillation shaft 20 is stopped when the sheet-like blank material E is fixed by the braking members 77*b*1 and 80. When the first oscillation shaft 20 is kept stopped, the first gap 91 between the upper surface of the release arm 76*b* and the lower surface of the braking arm 77*b* and the second gap 92 between the lower surface of the projection 77*b*2 of the braking member 77*b* and the opposing surface of the groove 82' are considerably large. However, the third gap 88 between the lower surface of the flat plate portion 86*a* of the operation member 86 and the upper surface of the joint member 85 is considerably smaller than that in the state shown in FIG. 1.

Soon after the stopping of the first oscillation shaft 20, the second oscillation shaft 21 starts to oscillate counter-clockwise as indicated by an arrow G and, almost simultaneously, the first roll 2 and the second roll 5 start to oscillate clockwise and counter-clockwise, i.e., in the directions counter to the feeding directions, respectively. Since the oscillation of both rolls is made while the second roll 5 is below the position shown in FIG. 1, the sheet-like blank material E is never fed back to the left but is held still. Then, as a result of the upward oscillation of the second oscillation shaft 21 indicated by the arrow G, the right end portion of the brake arm 77*b* is depressed by the action of the joint member 85*c* so that the brake arm 77*b* pivots clockwisely around the fulcrum constituted by the brake pivot shaft 79, thus moving the movable braking member 77*b*1 downwardly. In consequence, the sheet-like blank material E is released from the braking force which has been exerted by the braking members 77*b*1 and 80. It will be understood that the clockwise pivoting of the brake arm 77*b* is made while reducing the first and second gaps 91, 92 because, during this operation, the release arm 76*b* is kept stationary.

The counter-clockwise oscillation of the second oscillation shaft 21 as indicated by the arrow G is stopped after the braking members 77*b*1 and 80 have released the sheet-like blank material E. In this state, the required machining such as shearing or press work is effected on the portion of the sheet-like blank material which has been already fed rightward to the working station by the intermittent feeding action of both rolls 3 and 5.

The rolls 3 and 5 continue to oscillate in the directions counter to the feeding directions almost by the time at which the machining the sheet material is finished and are then stopped. Then, the clockwise oscillation of the first oscillation shaft 20 and the clockwise oscillation of the second oscillation shaft 21 are commenced substantially concurrently with the stopping of both rolls. It will be understood that, when the first and the second oscillation shaft oscillate clockwise, the release arm 76*b* and the brake arm 77*b* pivot in the direction counter to the direction of the pivotary movement thereof caused by the counter clockwise oscillation of the oscillation shafts 20 and 21, i.e., in the counter clockwise direction about the release pivot shaft 78 and the brake pivot shaft 79. As a result, the release arm 76*b* and the brake arm 77*b* are returned to the positions shown in FIG. 1. In this state, the sheet-like blank material E is held between both rolls and the movable braking member 77*b*1 has been spaced from the sheet-like blank material E. Then, both rolls 3 and 5 oscillate in the feeding directions such as to feed the sheet-like blank material to the right, thus commencing the same operation cycle as that described before.

The construction and operation of the arms 77*b* and 76*b* in relation to the arm actuating device 81 have been described with reference to FIG. 1 which shows only the parts associated with the brake arm 77*b* and the release arm 76*b* which are disposed at the right side in FIG. 2. It is to be noted, however, the brake arm 77*a* shown at the left side portion of FIG. 2 has the same construction as the brake arm 77*b* and operates in the same manner as the brake arm 77*b*. Similarly, the release arm 76*a* disposed at the left side portion of FIG. 2 has the same construction as the release arm 77*b* and operates in the same manner as the release arm 77*b*. Namely, as explained before, both brake arms 77*a* and 77*b* are connected at their one ends (left ends in FIG. 1) commonly to the brake pivot shaft 79, and both release arms 76*a* and 76*b* are connected at their one ends commonly to the release pivot shaft 78. The arm connecting member 82, and first and second oscillation shafts 20, 21 shown in FIG. 1 are composed of members which extend in parallel with the second roll shaft 4 normally to the plane of FIG. 1, and a projection (not shown) which is formed on the brake arm 77*a* and similar to the projection 77*b*2 is received in the groove 82' formed in the arm connecting member 82. It is to be understood also that members corrsponding to the members such as the first spring 90, second spring 87, joint members 85*a*, 85*b*, 85*c*, operation plate 83 and the operation member 86 shown in FIG. 1 are provided also for the brake arms 77*a* and release arm 76*a* at respective suitable positions.

As will be understood from the foregoing description taken in conjunction with FIG. 1, in the roll feed apparatus of the invention, it is essential that both rolls 3, 5 and the first and second oscillation shafts 20 and 21 have to start and stop oscillation at suitable timings. Clearly, this can be accomplished if the three-dimensional cams incorporated in the oscillation driving device 1 are suitably designed.

In FIGS. 1 and 2, a reference numeral 93 designates an adjusting mechanism for adjusting the gap between both rolls 3 and 5 in accordance with the thickness of the sheet-like blank material E. More specifically, this adjusting mechanism 93 includes a pair of adjusting arms 94 which are mounted substantially at their mid portions (see FIG. 1) on the portions of the first roll shaft 2 projecting beyond both end surfaces 3*a* and 3*c* (see FIG. 2) of the first roll 3 and which are fitted at their one ends (right ends as viewed in FIG. 1) on a pivot shaft fixed to the housing 8 of the roll feed apparatus and extending substantially parallel to the first roll shaft 2. The adjusting mechanism 93 further has an upwardly extending screw rod 96 which is rotatably carried by a shaft 98 which interconnects the other ends (left ends as viewed in FIG. 1) of both adjusting arms 94. The screw rod 96 is provided at its upper end with a threaded portion 96*a* which extends upwardly through the wall 8*a* of the housing 8. A nut 97 is screwed to the upper end portion of the threaded portion 96*a* projected above the wall 8*a*. Therefore, the screw rod 96 is moved up and down as the nut 97 is screwed and unscrewed, thus causing the pair of adjusting arms 94 to pivot clockwise and counter-clockwise about the pivot shaft 95. This pivotal movement of the adjusting arms 94 in turn causes the first roll 3 to move up and down, thus optimizing the gap between both rolls 3 and 5 in accordance with the thickness of the sheet-like blank material, thus attaining a moderate clamping force exerted by both rolls on the sheet-like blank material.

As will be understood from the foregoing description, according to the invention, the first roll shaft 2 and the first roll 3 are moved up and down as a unit with each other when the adjusting mechanism 93 is operated. On the other hand, the second roll shaft 4 and the second roll 5 are moved up and down as a unit with each other in response to the operation of the arm actuating device 81. It is, therefore, essential that the left and right ends of the first and second rolls 2 and 4 are supported in such a manner as to allow the rotation of these shafts with respect to the housing 75, as well as the above-mentioned up and downward movement. Since such supporting means which supports a shaft on a housing for free rotation and vertical movement is known, no detailed description will be made hereinunder in this regards.

In the illustrated embodiment, the first and second rolls 3 and 5 for feeding the sheet-like blank material do not have circular cross-sections but have sector-shaped cross-sections. The use of the sector-shaped rolls permits a reduction in weight of the movable parts in the roll feed apparatus and contributes to the achievement of higher feed precision during the high-speed operation through reduction of the inertia.

As will be understood from the foregoing description, the roll feed apparatus of the invention employs first and second rolls which cooperate with each other in clamping therebetween a sheet-like blank material and feeding the same in one direction intermittently thus moving the sheet-like blank material to successive different working stations. According to the invention, this effect is derived from a novel construction in which the oscillation driving device 1 is drivingly connected to the first and second rolls 3 and 5 through a special driving connection device 6 which includes the connecting rod 11, first block 9, slider 10, second block 12, and first and second arms 13 and 14, such as to cause first and second rolls in opposite directions substantially by the same amount.

This arrangement is superior to the known apparatus shown in the U.S. Pat. No. 4,475,678 incorporating a gear-type driving connection device in that the degradation of feed precision attributable to the back-lash of gears in the driving connection device is avoided because of elimination of the necessity for any gears. This arrangement is also superior to the known arrangement shown in the U.S. patent application Ser. No. 519,174 in that the number of the parts is greatly reduced.

According to the invention, when the slider 10 is slid through the action of the connecting rod 11 as a result of operation of the oscillation driving device 1, the first and second rolls 3 and 5 are driven simultaneously is superior to the arrangement shown in the above-mentioned United States Patent Application in which the power of the first roll is transmitted to the second roll through the driving connection device, because the time lag of oscillation of the second roll behind the oscillation of the first roll is eliminted thereby ensuring a higher precision of feed.

According to the invention, when both rolls 3 and 5 and, hence, both roll shafts 2 and 4 are moved away from each other as a result of operation of the roll release device 7, the rolling member 13*a* on the first arm 13 and the rolling member 14*a* on the second arm 14 roll along the second guide groove 12' in the second block 12. As stated before, the second guide groove 12' extend in the direction of movement of both rolls caused by the operation of the roll release device. Therefore, the driving connection device 6 does not hinder the relative movement between both rolls 3 and 5 caused by the roll release device 7. Similarly, the connection driving device 6 does not hinder the movement of the first roll 3 caused by the adjusting mechanism 93 which is employed by the illustrated embodiment.

The roll release device incorporated in the roll feed apparatus of the invention includes: a pair of release arms which are mounted substantially at their mid portions on the portions of the second roll shaft projecting beyond both axial ends of the second roll and fitted at their one ends to a release pivot shaft; a pair of brake arms disposed between the release arms and the path of feed of the sheet-like blank material, the ends of the brake arms adjacent the one ends of the release arms being fitted to a brake pivot shaft; and an arm actuating device operatively connected to the other ends of the pair of release arms and the other ends of a pair of brake arms. By operating the arm actuating device by means of the oscillation driving device, the pair of release arms and the pair of brake arms are pivotally driven in a predetermined timed relation, thereby effecting the clamping of the sheet-like blank material between both rolls when these rolls oscillate in the feeding directions, unclamping of the material when the rolls are oscillated in the directions counter to the feeding directions, and the temporary fixing of the material at the time of unclamping such as to prevent excessive feeding of the material due to inertia. Thus, the pair of release arms and the pair of brake arms are pivotally driven in a predetermined timed relation such as to effect the clamping and unclamping of the sheet-like blank material, as well as temporary fixing and releasing of the same. This arrangement is quite simple and makes it possible to produce the roll feed apparatus at a low cost, and contributes to the enhancement of feeding precision particularly when the roll feed apparatus operates at a high speed.

In the described embodiment, the oscillation driving device incorporates an oscillation angle changing device 18 which allows a change in the angle of oscillation of the rolls 3 and 5 even during the operation of the roll feed apparatus. This arrangement permits an easy change in the amount of uni-directional feed of the sheet-like blank material advantageously.

What is claimed is:

1. A roll feed apparatus comprising: an oscillation driving device; a first roll integrally mounted on a first roll shaft; a second roll integrally mounted on a second roll shaft extending in parallel with said first roll shaft and adapted for cooperation with said first roll in clamping therebetween a sheet-like blank material and feeding the same; a driving connection means drivingly connecting said oscillation driving means to said first and second rolls in such a manner that, when said first roll is oscillated in one direction by a predetermined amount, said second roll is oscillated in the opposite direction by the same amount; and a roll release device adapted to move said rolls away from each other when said rolls are oscillated in the counter directions thereby releasing said sheet-like blank material from the clamping force; wherein said driving connection means includes a first block fixed to the housing of said roll feed apparatus and having a first guide groove extending in the direction of feed of said sheet-like blank material in alignment with the path of feed, a slider slidably engaging said first guide groove, a connecting rod through which said oscillation driving device is connected to said slider, a second block integral with said slider and having a second guide groove which orthogonally crosses said first guide groove and extending in the direction of movement of said rolls caused by the operation of said roll release device, a first arm integrally fitted at its one end to said first roll shaft and provided at its other end with a rolling member which engages with said second guide groove, and a second arm integrally fitted at its one end to said second roll shaft and provided at its other end with a rolling member engaging with said second guide groove and arranged in symmetry with said first arm with respect to said path of feed of said sheet-like blank material.

2. A roll feed apparatus according to claim 1, wherein said roll release device includes: a pair of release arms mounted substantially at their mid portions on the portions of said second roll shaft projecting beyond both axial end surfaces of said second roll and fitted at their one ends on a release pivot shaft which extends from said housing substantially in parallel with said second roll shaft; a pair of brake arms disposed between said release arms and the path of feed of said sheet-like blank material, the ends of said brake arms adjacent said one ends of said release arms being fitted to a brake pivot shaft which extends substantially in parallel with said second roll shaft, said brake arms being provided with movable braking members projecting therefrom towards said path of feed of said sheet-like blank material; a stationary braking member opposing said movable braking members across said path of feed of said sheet-like blank material; and an arm actuating device operatively connected to the other ends of said pair of release arms and the other ends of said pair of brake arms adapted to be driven by said oscillation driving device so as to operate said pair of release arms and said pair of brake arms in such a manner that, when said rolls are oscillated in the feeding directions, said second roll is moved towards said first roll, whereas, when said rolls are oscillated in the counter directions, said second roll is moved away from said first roll and temporarily holding said movable braking members in the close proximity of said stationary braking member.

3. A roll feed apparatus according to claim 2, wherein said arm actuating device includes: an arm connecting member having a groove loosely receiving projections formed on the other ends of said pair of brake arms and slidably engaging said the other ends of said pair of release arms; a first oscillation shaft arranged to be oscillated by said oscillation driving device at a predetermined timing and operatively connected to said pair of release arms and said arm connecting member through joint members; a second oscillation shaft adapted to be oscillated by said oscillation driving device at a predetermined timing and operatively connected to said pair of brake arms through joint members; a first spring adapted for urging said pair of release arms and said pair of brake arms such as to form a first gap therebetween and a second spring adapted for urging said arm connecting member towards the projections on said pair of brake arms such as to form a second gap in the portion of the space between said projections and said groove in said arm connecting members adjacent said first gap, said second gap being communicating with said first gap; whereby, when said first oscillation shaft is oscillated in one direction, said arm connecting member is slid towards said path of feed of said sheet-like blank material overcoming the force of said second spring and, at the same time, said pair of release arms assisted by said first spring causes said second roll to be moved pivotally away from said first roll, while said pair of brake arms are moved pivotally such as to bring said movable braking members to the positions near said stationary braking member, and, after an oscillation of said second oscillation shaft in a predetermined direction, said pair of brake arms are pivotally moved in such a direction as to reduce said first and second gaps, thus moving said movable braking member away from said stationary braking member.

4. A roll feed apparatus according to claim 1, wherein said oscillation driving device has an oscillation angle changing device which includes: an oscillation member adapted to be driven for oscillation about a stationary axis; and a slider mounted in said oscillation member for oscillation together with said oscillation member and for movement in the direction of axis of said oscillation member, whereby the angle of oscillation of said first and second rolls for a given oscillation angle of said oscillation member is changed by changing the amount of movement of said slider in the axial direction of said oscillation member.

5. A roll feed apparatus according to claim 1, wherein each of said first and second rolls is a sector roll having a sector-shaped cross-section.

* * * * *